US010400491B2

(12) United States Patent
Fleig et al.

(10) Patent No.: US 10,400,491 B2
(45) Date of Patent: Sep. 3, 2019

(54) HINGE COVER WITH DOOR STOP

(71) Applicant: WHIRLPOOL CORPORATION, Benton Harbor, MI (US)

(72) Inventors: Alexandre Fleig, St. Joseph, MI (US); Prafull Gandhi, Maharashtra (IN); Niyaz Ul Haque, Stevensville, MI (US); Manjur Tamboli, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 15/458,145

(22) Filed: Mar. 14, 2017

(65) Prior Publication Data

US 2018/0266155 A1 Sep. 20, 2018

(51) Int. Cl.

| | |
|---|---|
| ***E05D 11/00*** | (2006.01) |
| ***E05D 11/06*** | (2006.01) |
| ***F25D 23/02*** | (2006.01) |
| ***F25D 11/00*** | (2006.01) |

(52) U.S. Cl.

CPC ..... *E05D 11/0054* (2013.01); *E05D 11/06* (2013.01); *F25D 11/00* (2013.01); *F25D 23/025* (2013.01); *F25D 23/028* (2013.01); *E05Y 2900/31* (2013.01); *F25D 2323/021* (2013.01); *F25D 2323/023* (2013.01); *F25D 2323/024* (2013.01)

(58) Field of Classification Search

CPC ..... E05D 11/0054; E05D 11/06; F25D 2323/024; E05Y 2900/31; Y10T 16/533; Y10T 16/5335

See application file for complete search history.

(56) References Cited

U.S. PATENT DOCUMENTS

| | | | | |
|---|---|---|---|---|
| 136,040 | A * | 2/1873 | Darrell | E05D 11/06 16/375 |
| 4,609,234 | A | 9/1986 | Naniwa et al. | |
| 4,858,273 | A * | 8/1989 | Civitelli | E05D 11/06 16/236 |
| 5,187,837 | A | 2/1993 | Gunderson et al. | |
| 5,931,554 | A | 8/1999 | Koopman | |
| 5,975,663 | A * | 11/1999 | Becker | A47B 96/00 16/374 |
| 8,162,421 | B2 * | 4/2012 | Lim | E05D 11/0054 312/401 |
| 9,383,135 | B2 | 7/2016 | Park et al. | |

(Continued)

FOREIGN PATENT DOCUMENTS

| | | | | |
|---|---|---|---|---|
| DE | 2140155 A1 * | 2/1973 | ..... | E05D 11/06 |
| DE | 19547321 A1 * | 7/1996 | ..... | E05D 11/06 |

(Continued)

OTHER PUBLICATIONS

European Patent Office, "European Search Report" for European Application No. 18161172.4 dated Jul. 31, 2018 (7 pages).

*Primary Examiner* — Andrew M Roersma
(74) *Attorney, Agent, or Firm* — Price Heneveld LLP

(57) ABSTRACT

A hinge cover for a cabinet having a door stopper integrated therewith. The hinge cover includes a main body with a hook-shaped portion along a hinge axis, and a stopper portion that is offset from the hinge axis. When one or more doors are opened about the hinge axis, the stopper portion engages a surface of the door in a stop position.

20 Claims, 8 Drawing Sheets

(56) References Cited

U.S. PATENT DOCUMENTS

| | | | | |
|---|---|---|---|---|
| 2009/0179539 | A1 | 7/2009 | Henriksson et al. | |
| 2012/0032572 | A1* | 2/2012 | Lee | F25D 23/028 312/405 |
| 2012/0038258 | A1* | 2/2012 | Park | E05D 7/0027 312/405 |
| 2013/0221825 | A1* | 8/2013 | Bonomie | E05F 3/20 312/405 |
| 2015/0059126 | A1 | 3/2015 | Dubina et al. | |
| 2015/0233629 | A1* | 8/2015 | Choi | F25D 23/04 312/404 |
| 2016/0097580 | A1* | 4/2016 | Lee | F25D 23/028 312/405.1 |
| 2016/0252291 | A1 | 9/2016 | Kikuchi et al. | |

FOREIGN PATENT DOCUMENTS

| | | | | | |
|---|---|---|---|---|---|
| GB | 2252789 | A | * | 8/1992 | E05D 11/0081 |
| JP | H-08296952 | A | * | 11/1996 | F25D 23/00 |
| JP | 2000018812 | A | * | 1/2000 | F25D 23/00 |
| KR | 20090132391 | A | | 12/2009 | |
| WO | 2010140837 | A2 | | 12/2010 | |
| WO | 2011080109 | A2 | | 7/2011 | |
| WO | WO2015015776 | A1 | * | 2/2015 | F25D 23/00 |

* cited by examiner

HINGE COVER WITH DOOR STOP

BACKGROUND OF THE INVENTION

The present disclosure generally relates to hinge covers that include features for limiting the rotation of a door and preventing damage to the door or cabinet on which they are positioned.

SUMMARY OF THE INVENTION

According to one aspect, the disclosure provides a hinge cover for a refrigerator hinge assembly. The hinge cover includes a main body covering at least a portion of the refrigerator hinge assembly, a first portion extending from the main body, and a second portion extending from the main body. The first portion is disposed along a hinge axis of the refrigerator hinge assembly and the second portion being configured to engage a refrigerator door in a stop position.

In another aspect, the disclosure provides a refrigerator including a cabinet having at least one opening for access to an inner portion of the cabinet, at least one door for accessing the inner portion of the cabinet, a hinge assembly for coupling the door to the cabinet and having a hinge axis, and a hinge cover. The hinge cover includes a main body, a first portion extending from the main body, and a second portion extending from the main body. The first portion is disposed along the hinge axis. The second portion is configured to engage the at least one door in a stop position.

In yet another aspect, the disclosure provides a method for limiting movement of an inner door and an outer door, where the inner door and outer door are attached to a top surface of a refrigerator by at least one hinge assembly. The method includes providing a hinge cover for the at least one hinge assembly having a stopper portion that is offset from a hinge axis of the at least one hinge assembly. The method further includes engaging a first location on the outer door with the stopper portion when the outer door is opened substantially independently of the inner door. Additionally, the method includes engaging a second location on the outer door with the stopper portion when the outer door is opened substantially together with the inner door.

These and other features, advantages, and objects of the present invention will be further understood and appreciated by those skilled in the art by reference to the following specification, claims, and appended drawings.

DETAILED DESCRIPTION

Figure 1:
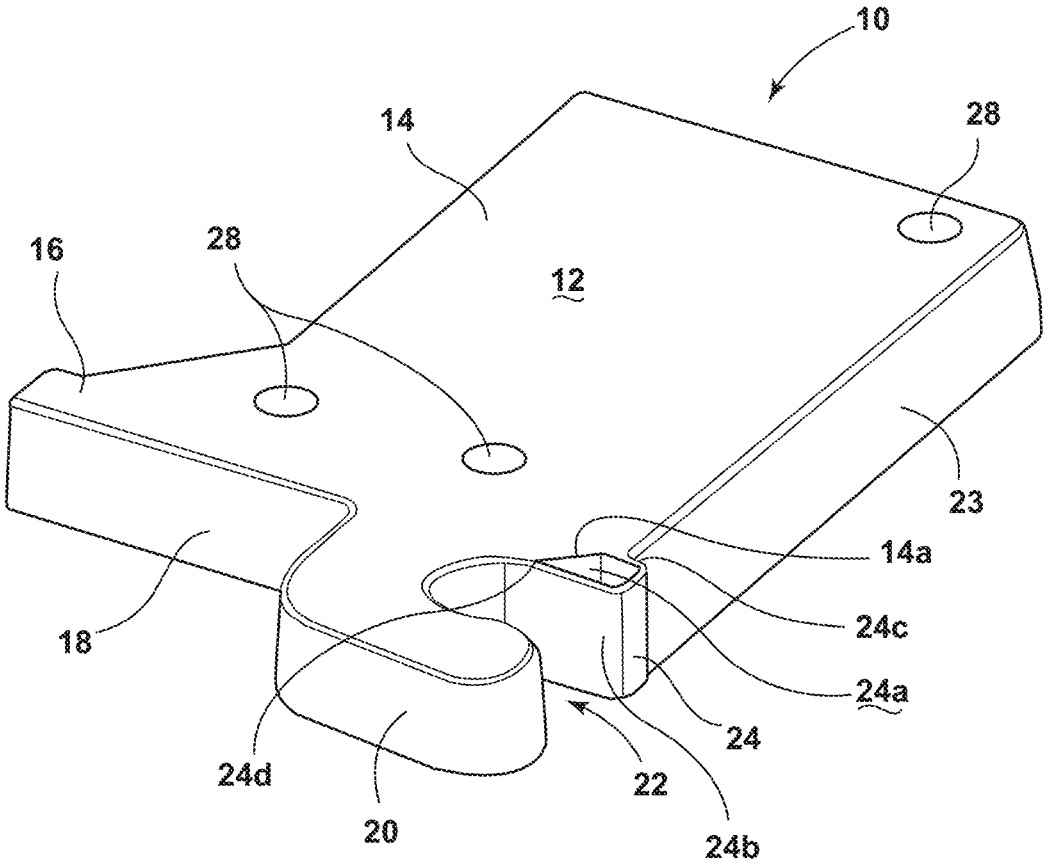
FIG. 1 is a top perspective view of a hinge cover according to an embodiment of the present disclosure.

The present disclosure provides a hinge cover with a door stopping mechanism. As described herein, the hinge cover may be used to cover at least a portion of a hinge assembly attaching a cabinet door to a cabinet, providing a more integrated and aesthetically pleasing look for the cabinet. In addition to improving an overall appearance for the cabinet, the hinge cover may also incorporate a stop surface for the cabinet door when opened. In some cases, a hinge cover as described herein may be used for a utility cabinet such as a kitchen cabinet or other utility-type cabinet. In other cases, the hinge cover may be configured for use with an appliance, such as a refrigerator. For example, as described in more detail below, a hinge cover and door stopper may be used to cover a hinge assembly on a side-by-side style refrigerator, and also limit the opening of a refrigerator door that is attached to the refrigerator by the hinge assembly. In at least one case, referring to FIGS. 1 and 2A-2C, a hinge cover 10 may cover an inner hinge assembly 120 on a French door-style refrigerator 100 having a double door feature, to limit the opening of each of the doors, and to prevent damage to a surface of an outer door when fully opened. Accordingly, as described in more detail below, at least one embodiment provides a hinge cover 10 having a main body 14, an extended member 20 and a stopper member 24. The extended member 20 may have a hook-shaped configuration and extend out from the main body 14 in proximity to the stopper member 24, defining a door stopping cavity 22. When a refrigerator door is opened, a portion of the door may move into the door stopping cavity 22 such that the stopper member 24 engages a surface of the door in a stop position.

The present illustrated embodiments reside primarily in combinations of apparatus components and method steps related to a hinge cover with a stopper member. Accordingly, the apparatus components and method steps have been represented, where appropriate, by conventional symbols in the drawings, showing only those specific details that are pertinent to understanding the embodiments of the present disclosure. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. For example, an element proceeded by "comprises a . . . " does not, without more constraints, preclude the existence of additional identical elements in the process, method, article, or apparatus that comprises the element.

For purposes of this disclosure, the term "coupled" (in all of its forms, couple, coupling, coupled, etc.) generally means the joining of two components directly or indirectly to one another. Such joining may be stationary in nature or movable in nature. Such joining may be achieved with the two components and any additional intermediate members being integrally formed as a single unitary body with one another or with the two components. Such joining may be permanent in nature or may be removable or releasable in nature unless otherwise stated.

Figure 2A:
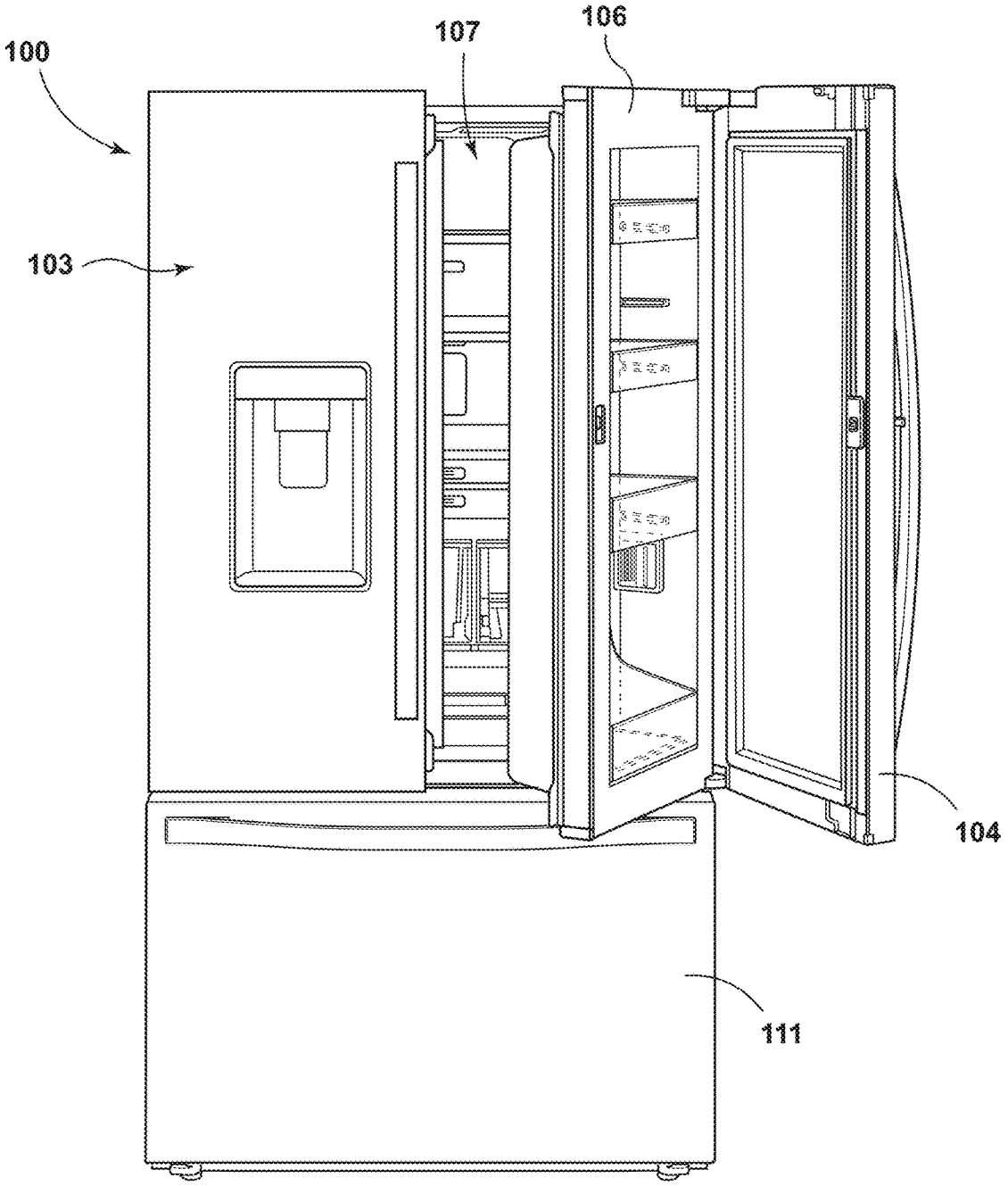
FIG. 2A is a front elevation view of a refrigerator on which the hinge cover may be positioned.
Figure 2B:
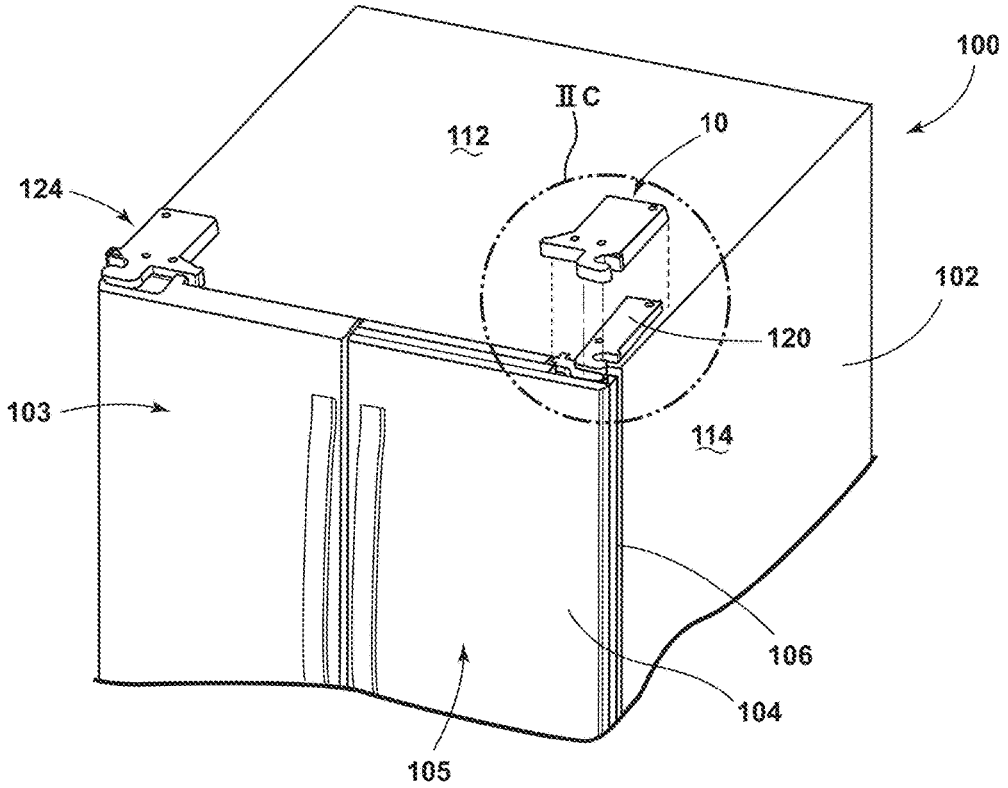
FIG. 2B is a top perspective view of the hinge cover positioned on the refrigerator, according to an embodiment of the present disclosure.
Figure 2C:
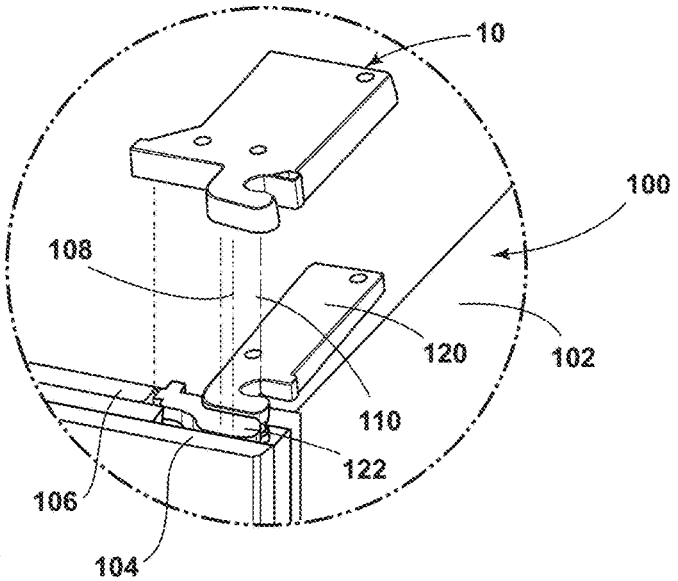
FIG. 2C is an exploded view of area IIC in FIG. 2B.

FIGS. 2A-2C depict an exemplary refrigerator 100 on which an embodiment of a hinge cover as described herein may be used. Refrigerator 100 includes an outer frame or cabinet 102 that incorporates one or more internal cavities 107 for cooling food items. Cabinet 102 includes a top surface 112, a pair of side surfaces 114, as well as a back surface and bottom surface (not shown). Refrigerator 100 may also incorporate one or more doors for accessing the one or more cavities 107, as would be known in the art. In the illustrated embodiment, refrigerator 100 is a French door-style refrigerator having a double door design, or in other words, a door-in-door configuration that can facilitate selective access to an inner cavity. Specifically, refrigerator 100 may include a pair of doors, door 103 and door assembly 105, and a freezer drawer 111, for access to the one or more internal cavities 107. As described in more detail below, door assembly 105 may include an outer door 104 and an inner door 106. As depicted in the illustrated embodiment, door 103 may be supported by a top hinge assembly (not shown), having a corresponding hinge cover 124. Door assembly 105 may be supported by an inner hinge assembly 120 and an outer hinge assembly 122, with a corresponding hinge cover 10 positioned over portions of one or both hinge assemblies. It should be noted that inner hinge assembly 120 and outer hinge assembly 122 are shown for purposes of example and illustration, and are not limiting features of the present disclosure. Those skilled in the art will understand that other types of hinge assemblies may be incorporated on refrigerator 100, such as a combined hinge assembly. Additionally, refrigerator 100 may include additional access drawers or doors, as would be known in the art. It should be understood that the alternative hinge configurations, and the absence or addition of one or more doors, drawers or other access components, does not affect the spirit and scope of the present disclosure.

According to one embodiment described herein, door assembly 105 includes an outer door 104 and an inner door 106. In operation, outer door 104 and the associated inner door 106 may be opened together, at the same time, or independently. Accordingly, an outer door 104 may be configured such that a person can access select portions of an inner cavity 107. For example, refrigerator 100 may be configured such that the opening of outer door 104, independently of an inner door 106, allows for selective access to a drink shelf or a specific refrigerator drawer. Selective access can serve to minimize the escape of cooled air and allow more efficient operation of the refrigerator. In such a case, outer door 104 may be configured for opening independently of inner door 106 about a first, or outer hinge axis 108 associated with an outer hinge assembly 122. Alternatively, when a person wants to access the entire inner cavity, inner door 106 and outer door 104 may be opened together about a second, inner hinge axis 110 associated with an inner hinge assembly 120. In the illustrated embodiment, inner hinge assembly 120 and inner hinge axis 110 are aligned with extended member 20 of hinge cover 10, and are located behind outer hinge axis 108. Thus, as described in more detail below, outer door 104 and inner door 106 may be opened together, with the two doors serving a single door function. Outer door 104 may also be opened independently of inner door 106, with inner door 106 remaining in a closed position and maintaining more of a temperature seal for the inner cavity. In addition, in some cases, outer door 104 and inner door 106 may also be opened at the same time, yet independently of each other.

Again, it will be understood that the embodiment of FIGS. 2A-2C and refrigerator 100 is shown by way of illustration only, and it should be understood that hinge cover 10 and associated methods described herein may be applicable to other types of cabinets or appliances. For example, the hinge cover may be used on other forms of refrigerators, such as, but not limited to, French door-style refrigerators having a single pair of doors, built in refrigerators, refrigerators having top and bottom doors, refrigerator and/or freezers having a single door, or any other cabinet or appliance cabinet configuration contemplated by a skilled artisan.

Referring now to FIGS. 1 and 3-5, in at least one embodiment, a hinge cover having a door stopping feature may be used both aesthetically and functionally to cover one or more hinge assemblies associated with a refrigerator 100. For example a hinge cover may be used to cover a hinge assembly, to protect the hinge assembly, and to provide a stopping mechanism for the doors of a refrigerator to limit an opening angle as well as to prevent damage to the door surface. According to the illustrated embodiment, a hinge cover 10 is provided that may cover, or partially cover, an inner hinge assembly 120 associated with door assembly 105, shown in FIGS. 2B and 2C.

As illustrated, hinge cover 10 includes a main body 14 that is configured for positioning and securement over a portion of inner hinge assembly 120 on a top surface 112 of cabinet 102. An elbow portion 16 extends from a side of main body 14. Elbow portion may be a triangular shaped member, or otherwise shaped to coincide with the shape of a hinge assembly disposed underneath. Hinge cover 10 may also include an extended member 20 extending from a side surface 18 of main body 14 and projecting out from cabinet 102 to cover a portion of inner hinge assembly 120 that is disposed along a hinge axis for the one or more doors associated with the cabinet. In the illustrated embodiment, extended member 20 is a hook-shaped member that extends from a front surface of main body 14 and is disposed over, or along, an inner hinge axis 110 associated with door assembly 105. In the embodiment of FIGS. 1 and 3-5, hinge cover 10 is configured to cover a top right side hinge assembly on a refrigerator 100, such that extended member 20 extends toward a side surface 114 on the right side of refrigerator 100. However, those skilled in the art will recognize that a hinge cover 10 may be configured in a reverse orientation to cover a top left hinge assembly, such as the position of hinge cover 124 in the illustrated embodiment. In such a reverse configuration, extended member 20 may extend toward a side surface 114 on the left side of refrigerator 100, but still operate substantially the same way as the top right configuration example of hinge cover 10. Additionally, it will be further understood that a hinge cover, as described herein, may be configured to attach to other surfaces of a cabinet, or may be oriented in a variety of ways that would be contemplated by a skilled artisan. For example, hinge cover 10 may be configured to cover a hinge mounted on a side surface or a bottom surface.

Figure 3:
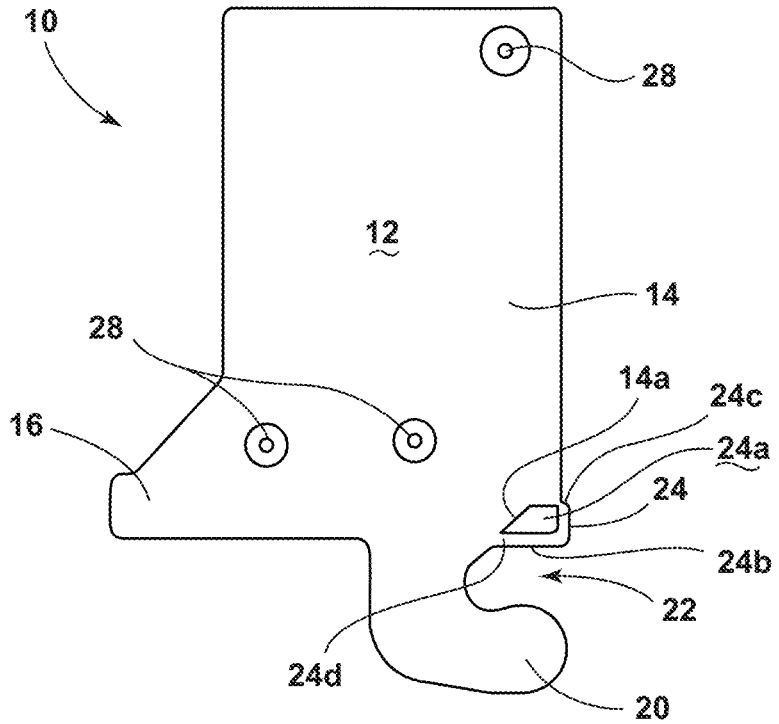
FIG. 3 is a top plan view of the hinge cover according to the embodiment of the present disclosure.
Figure 4:
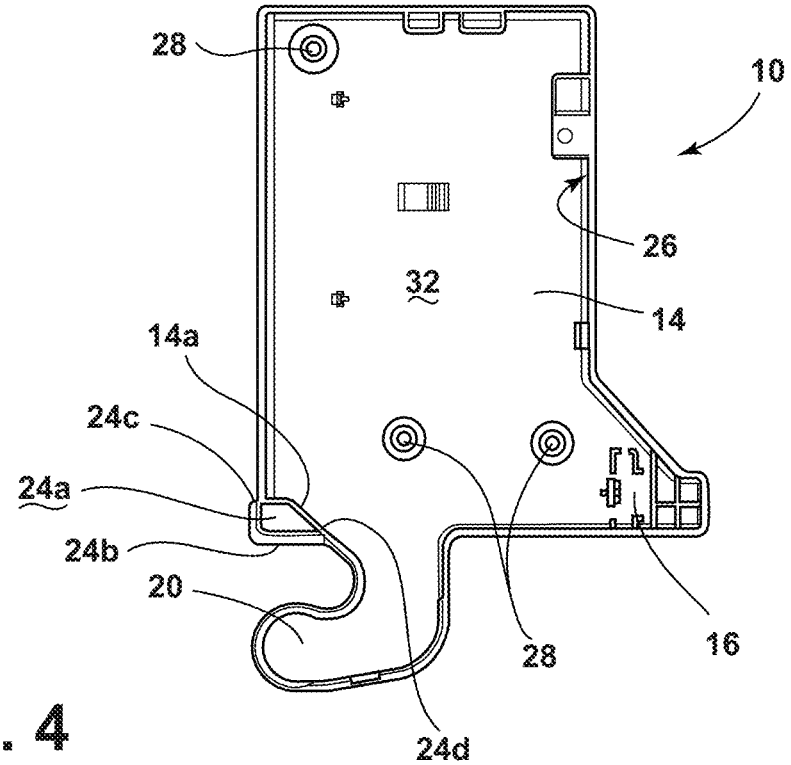
FIG. 4 is a bottom plan view of the hinge cover according to the embodiment of the present disclosure.
Figure 5:
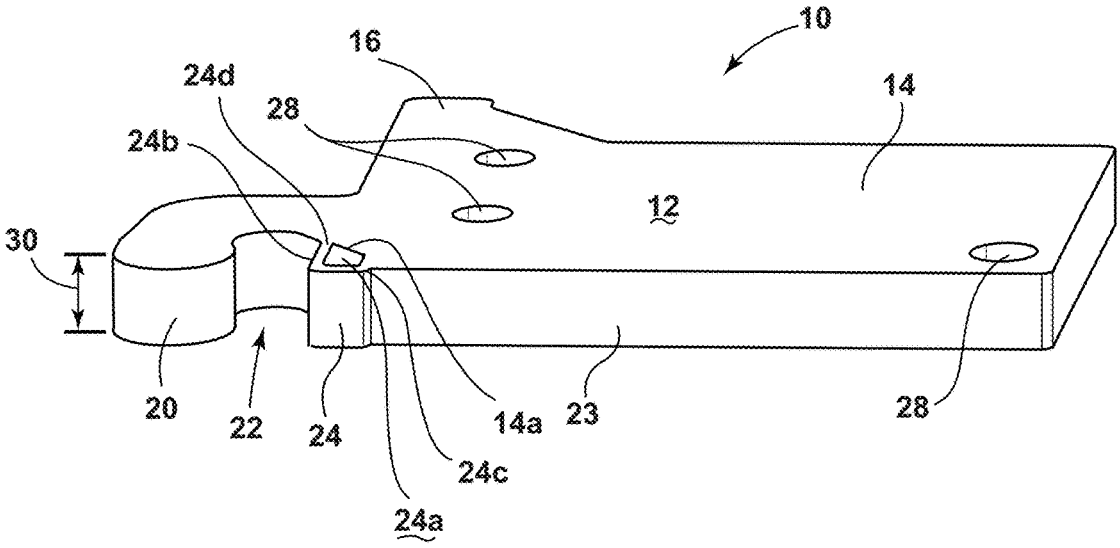
FIG. 5 is a side elevation view of the hinge cover according to the embodiment of the present disclosure.

Referring to FIGS. 3 and 4 of the illustrated embodiment, hinge cover 10 may include a top surface 12 and a side surface 18 extending perpendicularly and downward therefrom. In some embodiments, top surface 12 may be configured as a flat surface and side surface 18 may extend around the entirety of hinge cover 10, defining a hollow bottom area. Referring to a bottom view of hinge cover 10 depicted in FIG. 4, bottom area includes a bottom side surface 26 and a bottom surface 32. Accordingly, hinge cover 10 may include a depth or height 30, as shown in FIG. 5, that is proportioned to fit over or otherwise cover inner hinge assembly 120. In some cases, height 30 corresponds with a height of at least a portion of inner hinge assembly 120. In other cases, however, top surface 12 may take on different geometries including a rounded geometry, or other geometry as would be required by the surface geometry of the underlying hinge assembly. In addition, in some embodiments, side surface 18 may extend around only a portion of the hinge cover 10, may be provided with a varying geometry or angled other than perpendicularly with respect to top surface 12, or may be absent altogether.

Hinge cover 10 may also include provisions to limit the movement of a cabinet door as well as to protect the surface of the door when the door is opened. For example, hinge cover 10 may include a surface, a projection, or a separate member otherwise coupled thereto, to serve as a door stopper. In some embodiments, hinge cover 10 may include a door stopping mechanism integrated with main body 14. In at least one case, hinge cover 10 includes stopper member 24 extending from main body 14 along an outside side surface 23. Stopper member 24 may project outward from side surface 23 as a rectangular surface with rounded or blunt edges, configured to engage with a surface of outer door 104 in a stop position, but not damage the surface. In the illustrated embodiment, stopper member 24 may project away from side surface 23 to form a side of door stopping cavity 22 having extended member 20. As discussed in more detail below, in operation, stopper member 24 of hinge cover 10 may limit the movement of refrigerator doors 105, and in particular outer door 104, in an opened position. The stopper member 24 may include a stopper space 24*a* defined by an outer wall 14*a* of the main body 14 portion and a stopper wall 24*b*. The stopper wall 24*b* may receive the outer door 104 when the outer door 104 is fully opened with the inner door 106 (FIG. 6) and when the outer door 104 is opened independent of the inner door 106 (FIG. 7). The stopper wall 24*b* may include a first end 24*c* attached to the main body 14 portion and a second end 24*d* attached to the main body 14 portion. A portion of the stopper wall 24*b* may partially define the door stopping cavity 22.

Hinge cover 10 may be configured with one or more apertures or other elements for fastening the cover to a surface of the cabinet or hinge assembly. In the illustrated embodiment, hinge cover 10 includes one or more apertures 28 for receiving fasteners for securing the hinge cover to refrigerator 100 or to inner hinge assembly 120. Apertures 28 may be configured to receive a fastener such as a threaded screw, bolt, or other elongated tab. However, those skilled in the art will recognize that hinge cover 10 may be configured to fasten to the refrigerator in a variety of ways, and is not limited to those described herein.

Referring to FIGS. 2B and 2C, in some cases, hinge cover 10 may be fastened to a top surface 112 of refrigerator 100 above or over an inner hinge assembly 120. In the illustrated embodiment, extended member 20 extends outward from refrigerator cabinet 102, and is positioned in a recess of outer door 104 and inner door 106. Further, extended member 20 may be positioned over an inner hinge axis 110 and inward of an outer hinge axis 108. Again, those skilled in the art will recognize that the placement and configuration of hinge cover 10 may be varied according to the shape and configuration of a hinge cover, and will still fall within the spirit and scope of the present disclosure. For instance, a hinge cover as described herein may include an extended member that is not hook-shaped or may exclude an extended member altogether.

Hinge cover 10 may be constructed from any of a wide variety of materials that provide sufficient strength or durability, in any of a wide variety of colors, textures, and combinations. For example, hinge cover 10 may be constructed of a polymer such as a plastic material, a metal, a rubber material, or any other rigid or semi-rigid material configured to hold shape. Thus, it will be understood by one having ordinary skill in the art that construction of the components described herein is not limited to a specific material.

As discussed above, hinge cover 10 may serve both an aesthetic and functional component on a refrigerator cabinet. In at least one case, hinge cover 10 may be used to cover and protect a cabinet door hinge assembly, and may also provide a door stopping mechanism for refrigerator doors connected via one or more hinge assemblies, such as inner hinge assembly 120 and outer hinge assembly 122, as illustrated in FIGS. 6-7.

Figure 6:
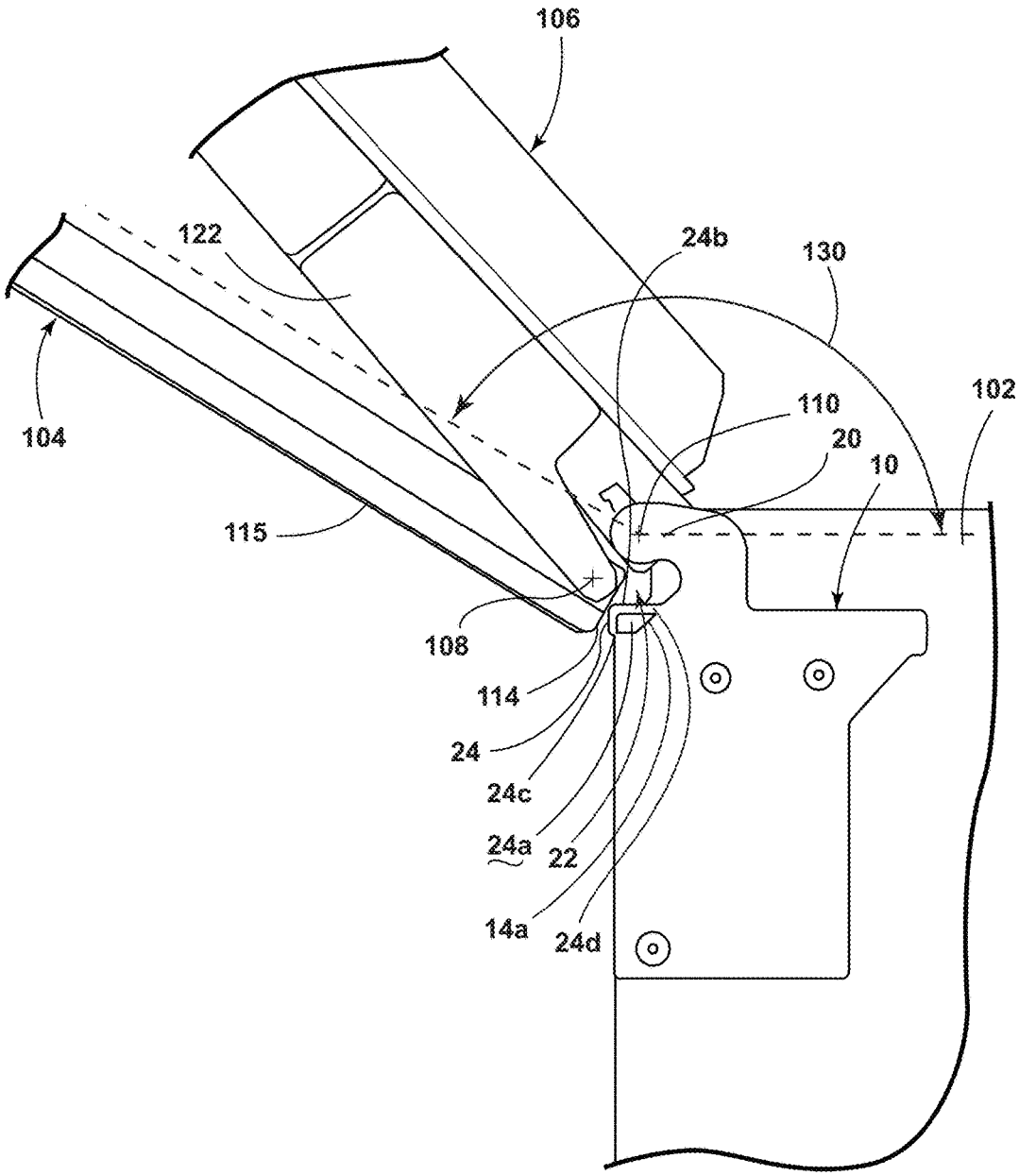
FIG. 6 is a partial top view of the hinge cover and refrigerator with opened doors, according to an embodiment of the present disclosure.
Figure 7:
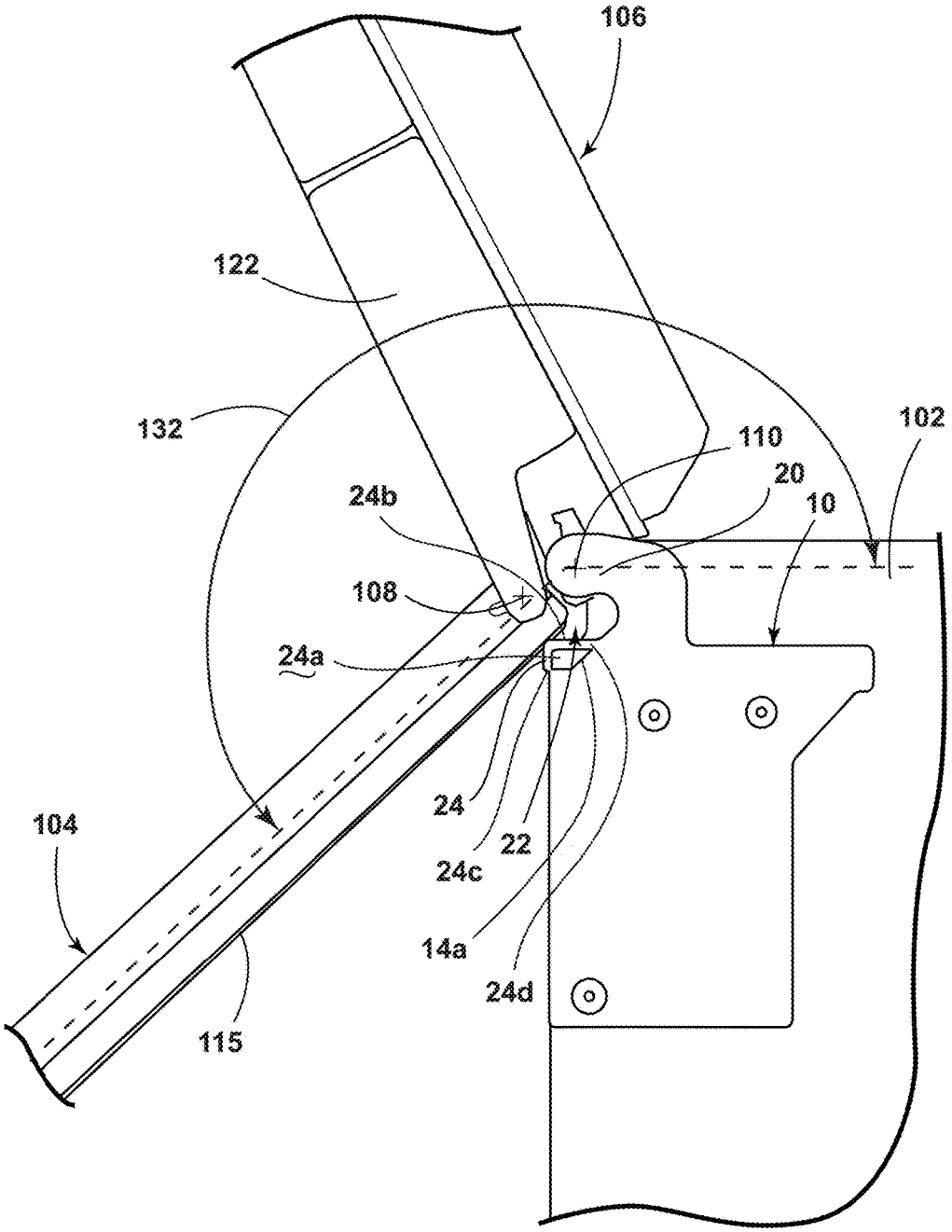
FIG. 7 is another partial top view of the hinge cover and refrigerator with opened doors, according to an embodiment of the present disclosure.

FIGS. 6 and 7 depict a top view of hinge cover 10 coupled with refrigerator cabinet 102 and in operation as a door stopper. In particular, FIG. 6 depicts how inner door 106 and outer door 104 may interact with hinge cover 10 and stopper member 24 when the doors are opened together, or substantially together, as shown in the figure. FIG. 7, on the other hand, depicts how inner door 106 and outer door 104 may interact with hinge cover 10 and stopper member 24 when the doors are rotated substantially independently of each other. In both figures, stopper member 24 engages a surface of outer door 104 in a stop position, serving to limit the rotation of outer door 104 about outer hinge axis 108, and at the same time, protect an outer surface of outer door 104.

Referring first to FIG. 6, in operation, outer door 104 and inner door 106 may be opened together about inner hinge axis 110. FIG. 6 depicts outer door 104 slightly ajar from inner door 106 about outer hinge axis 108, however, the configuration and operation may also be the same when inner door 106 and outer door 104 are opened together as a door assembly 105. When the doors are opened together and rotated about inner hinge axis 110, stopper member 24 engages outer door 104 in a stop position on a side surface 114. The stopper wall 24*b* and the main body 14 may define a stopper space 24*a* therebetween. The stopper wall 24*b* may selectively receive the outer door 104 in a slightly ajar position. The stopper wall 24*b* may include first end 24*c* attached to the outer wall 14*a* of the main body 14 and a second end 24*d* attached to the outer wall 14*a* of the main body 14. Accordingly, when the doors are opened substantially together as shown in FIG. 6, stopper member 24 prevents outer door 104 and inner door 106 from opening beyond a maximum rotation 130 about inner hinge axis 110. In at least one case maximum rotation 130 of outer door 104, when opened substantially together with inner door 106, is less than 180 degrees. In other cases, the maximum rotation 130 may be greater than 180 degrees, but less than a maximum rotation 132 shown in FIG. 7, when inner door 106 and outer door 104 are opened independently. In some embodiments, the maximum rotation 130 may be adjusted with the location and amount that stopper member 24 protrudes from side surface 23. Furthermore, as shown in FIG. 6, when outer door 104 and inner door 106 are opened together, stopper member 24 prevents additional rotation of outer door 104 about outer hinge axis 108.

FIG. 7 depicts the operation of outer door 104 and inner door 106 when rotated or opened independently about outer hinge axis 108 and inner hinge axis 110, respectively. More specifically, FIG. 7 depicts outer door 104 fully ajar from inner door 106 about outer hinge axis 108, with inner door 106 also rotated about inner hinge axis 110, and away from refrigerator cabinet 102. When the doors are opened independently, and rotated about both outer hinge axis 108 and inner hinge axis 110, stopper member 24 engages outer door 104 in a stop position on a front surface 115 of outer door 104. The stopper wall 24*b* and the main body 14 may define a stopper space 24*a* therebetween. The stopper wall 24*b* may selectively receive the outer door 104 in a fully-open position. The stopper wall 24*b* may include a first end 24*c* attached to the outer wall 14*a* of the main body 14 and a second end 24*d* attached to the outer wall 14*a* of the main body 14. Accordingly, when outer door 104 and inner door 106 are opened independently, stopper member 24 prevents outer door 104 and inner door 106 from opening beyond a maximum rotation 132 about inner hinge axis 110. In at least one case, when outer door 104 is opened substantially independently of inner door 106, the maximum rotation 132 is about 205 degrees. In other cases, maximum rotation 132 may be more or less than 205 degrees based on the specific configuration or location of stopper member 24 and the amount that stopper member 24 protrudes from side surface 23.

Figure 8:
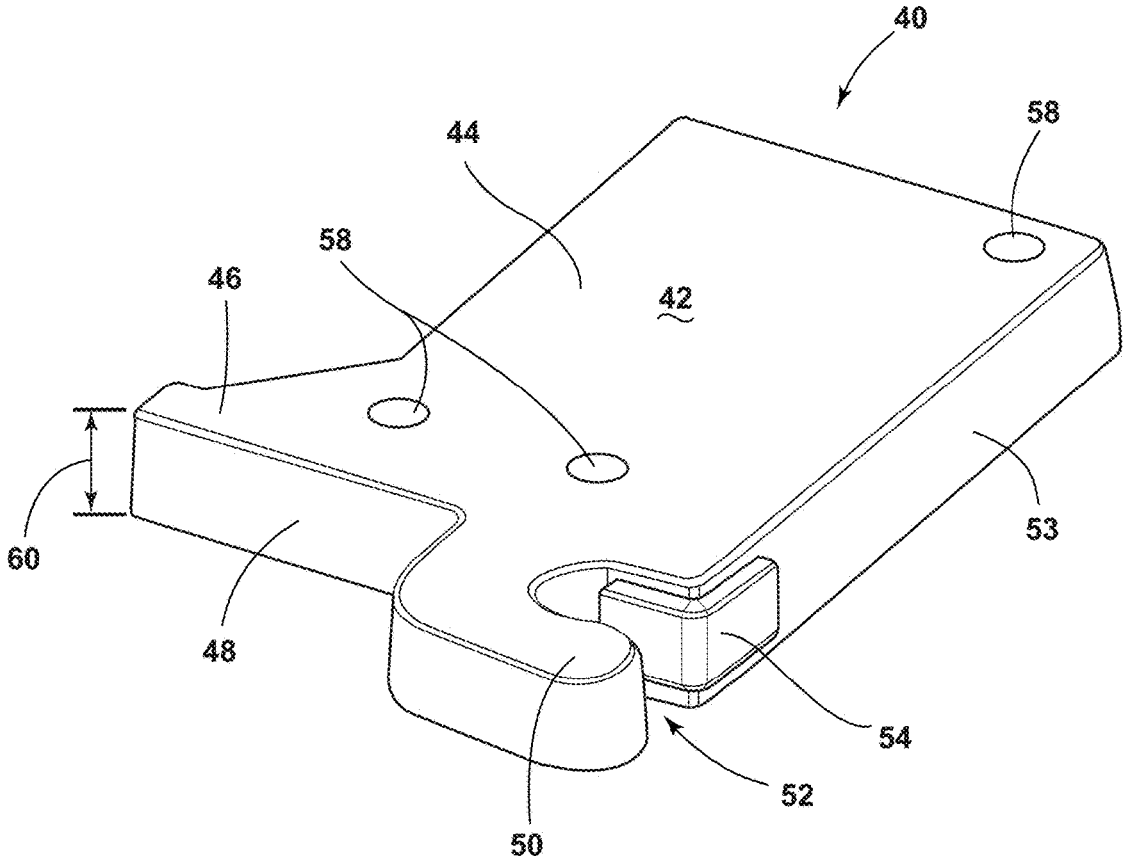
FIG. 8 is a top perspective view of a hinge cover according to another embodiment of the present disclosure.

FIG. 8 depicts another embodiment of a hinge cover 40, according to aspects described herein. Hinge cover 40 is embodied similar to hinge cover 10 and may be configured to cover a hinge assembly on a refrigerator, such as inner hinge assembly 120 on refrigerator 100 as described above. As shown in FIG. 8, hinge cover 40 includes a main body 44 that may be configured for positioning and securement over a portion of an inner hinge assembly 120 on a top surface 112 of cabinet 102. An elbow portion 46 extends from a side of main body 44. Elbow portion may be a triangular shaped member, or otherwise shaped to coincide with the shape of a hinge assembly disposed underneath. Hinge cover 40 may also include an extended member 50 extending from a side surface 48 of main body 44 and projecting out from cabinet 102 to cover a portion of inner hinge assembly 120 that is disposed along a hinge axis for the one or more doors associated with the cabinet 102. In the illustrated embodiment, extended member 50 is a hook-shaped member that extends from a front surface of main body 44 and may be disposed over an inner door hinge axis, similar to inner hinge axis 110 that is associated with door assembly 105 depicted in FIG. 2B. In the embodiment of FIG. 8, similar to the embodiment depicted in FIGS. 1 and 3-5, hinge cover 40 is depicted in a configuration that could cover a top right side hinge assembly on a refrigerator 100, such that extended member 50 extends toward a side surface 114 on the right side of refrigerator 100. However, those skilled in the art will recognize that the hinge cover 40 may be configured in a reverse orientation to cover a top left hinge assembly, where, for example, an extended member 50 would extend toward a side surface 114 on the left side of refrigerator 100.

Similar to the hinge cover 10, hinge cover 40 may be configured with a top surface 42 and a side surface 48 extending perpendicularly and downward therefrom. In some embodiments, top surface 42 may be configured as a flat surface and side surface 48 may extend around the entirety of hinge cover 40, creating a hollowed out bottom area. Hinge cover 40 may have a depth or height 60, that is proportioned to fit over or otherwise cover portions of one or more hinge assemblies, such as inner hinge assembly 120 and outer hinge assembly 122. Accordingly, in some cases, height 60 corresponds with a height of at least a portion of inner hinge assembly 120 that hinge cover 40 may be configured to cover. In other cases, however, top surface 42 may take on different geometries, including a rounded geometry, or other geometry as would be required by the surface geometry of the underlying hinge assembly. In addition, in some embodiments, side surface 48 may extend around only a portion of the hinge cover 10, may be provided with a varying geometry or angled other than perpendicularly with respect to top surface 42, or may be absent altogether.

Hinge cover 40 may also be configured with one or more apertures or other elements for fastening the cover to a surface of the cabinet or hinge assembly. In the illustrated embodiment, hinge cover 40 includes one or more apertures 58 for receiving fasteners for securing the hinge cover to refrigerator 100 or inner hinge assembly 120. Apertures 58 may be configured to receive a fastener such as a threaded screw, bolt, or other elongated tab. However, those skilled in the art will recognize that hinge cover 40 may be configured to fasten to the refrigerator in a variety of ways, and is not limited to those described herein.

Hinge cover 40 may also include a door stopping mechanism integrated with main body 44 to limit the movement of the cabinet door as well as to protect the surface of the door when the door is opened. As shown in FIG. 8, hinge cover 40 includes stopper member 54 extending from main body 44 along an outside side surface 53 as well as along a surface of door stopping cavity 52. In the embodiment of FIG. 8, stopper member 54 is a separate member that is attached to or otherwise coupled with main body 44 by techniques known and contemplated by a skilled artisan, e.g., by adhesive or the use of fasteners. In some cases, stopper member 54 may comprise a different material than main body 44. For example, in one embodiment, stopper member 54 may comprise a material that is softer than a material of main body 44. In at least one case, stopper member 54 may comprise a soft plastic material or rubber material having dampening characteristics. However, in other cases, stopper member 54 may be comprised of the same material as main body 44, and still provide a stopping surface for a cabinet door.

Hinge cover 40 may also be configured to fasten to a top surface 112 of refrigerator 100 such as over inner hinge assembly 120. In other cases, however, hinge cover 40 may be configured to cover a hinge mounted on a side surface or a bottom surface. In the illustrated embodiment, extended member 50 is positioned outward from refrigerator cabinet 102 and in a recess of outer door 104 and inner door 106. In addition, extended member 50 may be positioned over an inner hinge axis 110 and inward of outer hinge axis 108. Those skilled in the art will recognize that the placement and configuration of hinge cover 40 may be varied according to the shape and configuration of the hinge cover, and is not limited by the specific configuration shown and described herein.

It is important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes, and proportions of the various elements, values of parameters, mounting arrangements, use of materials, colors, orientations, etc.) without materially departing from the spirit and scope of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It is also to be understood that variations and modifications can be made on the aforementioned structures and methods without departing from the concepts of the present disclosure, and further it is to be understood that such concepts are intended to be covered by the following claims unless these claims by their language expressly state otherwise.

The invention claimed is:

1. An appliance, the appliance including a cabinet having at least one opening for access to an inner portion of the cabinet, an inner door for accessing the inner portion of the cabinet and an outer door for accessing select portions of the inner portion of the cabinet, a hinge assembly comprising a stationary inner door hinge axis and an outer door hinge axis that is configured to rotate around the stationary inner door hinge axis, the hinge assembly for coupling the inner and outer doors to the cabinet, and a hinge cover, the hinge cover comprising:

a main body portion covering at least a portion of the hinge assembly; and a stopper member and an extending member extending outward from the main body portion and defining a door stopping cavity therebetween, wherein a portion of the outer door is positioned in the door stopping cavity and an outermost surface of the stopper member engages a front surface of the outer door in a stop position when the outer door is opened independently of the inner door and the inner door is rotated about the stationary inner door hinge axis away from the cabinet, and wherein the stopper member includes a stopper space defined by an outer wall of the main body portion and a stopper wall, wherein the stopper wall receives the outer door when the outer door is fully opened with the inner door and when the outer door is opened independent of the inner door.

2. The appliance of claim 1, wherein the outermost surface of the stopper member engages a side surface of the outer door when the inner door and the outer door are opened together and rotated about the inner door hinge axis.

3. The appliance of claim 1, wherein the hinge cover comprises:

the extending member extending from the main body portion, and disposed along the stationary inner door hinge axis of the hinge assembly.

4. The appliance of claim 3, wherein the extending member is hook-shaped and is integrally formed with the main body portion.

5. The appliance of claim 1, wherein:

the hinge cover is located proximate a top surface of the cabinet.

6. The appliance of claim 1, wherein the stopper member is integrally formed with the main body portion.

7. The appliance of claim 6, wherein the stopper wall comprises a first end attached to the main body portion and a second end attached to the main body portion.

8. The appliance of claim 1, wherein:

the stopper wall partially defines the door stopping cavity.

9. The appliance of claim 1, wherein the stopper member extends along an outside side surface of the main body portion and along a surface of the door stopping cavity.

10. A refrigerator, the refrigerator including a cabinet having at least one opening for access to an inner portion of the cabinet, a door including an outer door and an inner door for accessing the inner portion of the cabinet, a hinge assembly for coupling the outer door and the inner door to the cabinet and having a hinge axis, and a hinge cover, the hinge cover comprising:

a main body;

a first portion extending from the main body and disposed along the hinge axis;

a second portion that includes a stopper wall that extends laterally outward from the main body, wherein an outermost surface of the stopper wall engages an upper portion of the outer door in at least one stop position; and wherein a triangular shaped elbow portion extends from the main body, along a side surface of the main body, and away from the first and second portions, and wherein the stopper wall and the main body define a stopper space therebetween, the stopper wall selectively receiving the outer door in the at least one stop position.

11. The refrigerator of claim 10, wherein:

the outer door stops at a first stop position of the at least one stop position when the outer door is opened independently of the inner door, and wherein a front surface of the outer door contacts the outermost surface of the second portion to define the first stop position.

12. The refrigerator of claim 11, wherein:

the outer door stops at a second stop position of the at least one stop position when the outer door is opened while engaged with the inner door, and wherein a side surface of the outer door contacts the outermost surface of the second portion to define the second stop position.

13. The refrigerator of claim 11, wherein the hinge axis is a stationary inner door hinge axis, and the refrigerator further comprises:

an outer door hinge axis that is configured to rotate around the stationary inner door hinge axis.

14. The refrigerator of claim 13, wherein the second portion and the first portion define a door stopping cavity therebetween, such that a portion of the outer door is received in the door stopping cavity when the outer door is at the at least one stop position.

15. The refrigerator of claim 13, wherein the stopper wall includes a first end attached to the outer wall of the main body and a second end attached to the outer wall of the main body.

16. The refrigerator of claim 10, wherein the hinge cover is disposed in a recess in the cabinet, and wherein a top of the hinge cover is substantially level with a top of the inner door.

17. A method for limiting movement of an inner door and an outer door on a refrigerator, wherein the inner door and outer door are attached to a top surface of the refrigerator by at least one hinge assembly, the method comprising:

providing a hinge cover for the at least one hinge assembly, the hinge cover having a main body and a stopper portion that is offset from a hinge axis of the at least one hinge assembly and extends outward from the main body, and includes a stopper space defined between a stopper wall and an outer wall of the main body;

positioning the hinge cover for the at least one hinge assembly proximate the top surface of the refrigerator;

engaging a front surface on the outer door with an outermost surface of the stopper portion when the outer door is opened substantially independently of the inner door to define a first stop position of the outer door;

positioning a portion of the outer door into a door stopping cavity such that the stopper wall engages a surface of the outer door in the first stop position of the outer door when the outer door is opened substantially independently of the inner door to define the first stop position of the outer door; and engaging a side surface on the outer door with the outermost surface of the stopper wall when the outer door is opened substantially together with the inner door to define a second stop position of the outer door.

18. The method of claim 17, further comprising:

integrally forming the stopper portion with the hinge cover; and providing a triangular elbow portion extending from the main body of the hinge cover.

19. The method of claim 17, further comprising:

constructing the hinge axis to be a stationary inner door hinge axis; and providing the refrigerator with an outer door hinge axis that is configured to rotate around the stationary inner door hinge axis.

20. The method of claim 17, further comprising:

forming the stopper portion so that a portion of the stopper wall partially defines the door stopping cavity.

* * * * *